US010517389B2

(12) United States Patent
Birk

(10) Patent No.: US 10,517,389 B2
(45) Date of Patent: Dec. 31, 2019

(54) PROCESS AND APPARATUS FOR CREATING TUFTS FOR TUFTED ARTICLE

(71) Applicant: The Procter & Gamble Company, Cincinnati, OH (US)

(72) Inventor: Andreas Birk, Kronberg (DE)

(73) Assignee: The Procter & Gamble Company, Cincinnati, OH (US)

( * ) Notice: Subject to any disclaimer, the term of this patent is extended or adjusted under 35 U.S.C. 154(b) by 654 days.

(21) Appl. No.: 14/075,585

(22) Filed: Nov. 8, 2013

(65) Prior Publication Data

US 2015/0130259 A1 May 14, 2015

(51) Int. Cl.
*A46D 1/08* (2006.01)

(52) U.S. Cl.
CPC ..... *A46D 1/08* (2013.01)

(58) Field of Classification Search
CPC ..... A46D 1/04; A46D 1/08
USPC ..... 300/5, 21, 7, 8
See application file for complete search history.

(56) References Cited

U.S. PATENT DOCUMENTS 3,836,199 A * 9/1974 Blankschein ..... A46D 3/082 300/19
4,291,431 A * 9/1981 Lewis, Jr. ..... A46B 3/06 15/159.1
5,344,218 A 9/1994 Weilhrauch et al.
2008/0012420 A1 1/2008 Boucherie
2012/0013169 A1 1/2012 Rees
2013/0038115 A1 2/2013 Stein et al.

FOREIGN PATENT DOCUMENTS

JP S61280805 12/1986
JP S63318906 12/1988
JP 11206459 A * 8/1999
JP H11206459 8/1999

OTHER PUBLICATIONS

International Search Report and Written Report, dated Jan. 29, 2015, 10 pages.

* cited by examiner

*Primary Examiner* — Laura C Guidotti
(74) *Attorney, Agent, or Firm* — Parker D. McCrary; Vladimir Vittenberg

(57) ABSTRACT

A process for creating multiple tufts for a tufted article comprises directing the initial filament bundle into a first channel, causing the bundle to move through the first channel while splitting the bundle into a plurality of tufts according to a predetermined pattern, and directing the plurality of tufts into the plurality of second channels such that each of the plurality of tufts has its own second channel. An apparatus comprises a first plate having a first channel for receiving a filament bundle, a splitting element for separating the bundle into the plurality of individual tufts, a second plate having a plurality of second channels for receiving the plurality of tufts, and a driving means for moving the filaments in the channels.

5 Claims, 7 Drawing Sheets

Fig. 1D2

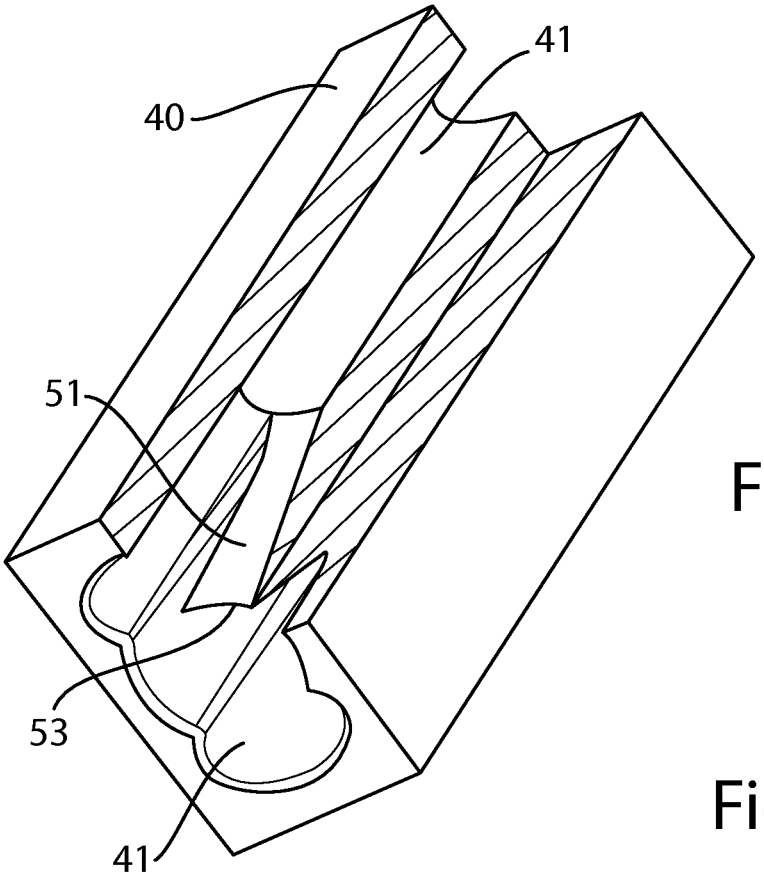
Fig. 3A
Fig. 3B
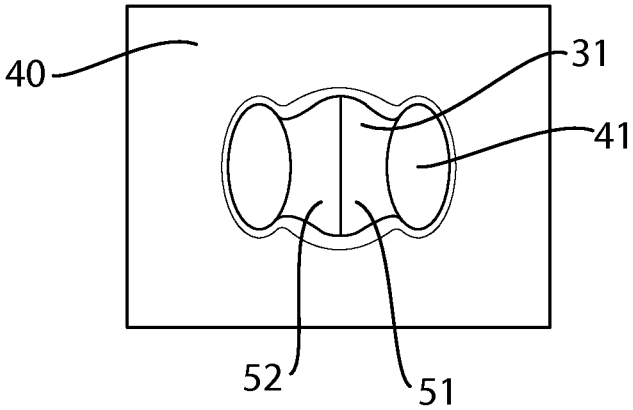
Fig. 3C
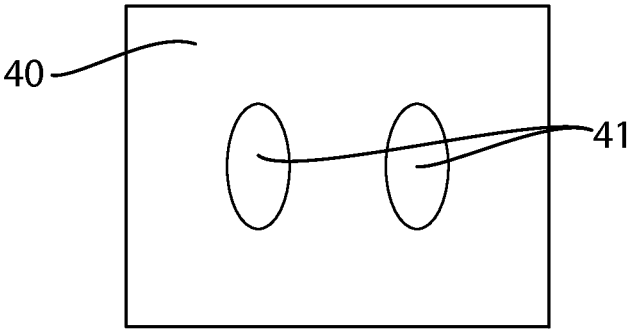

PROCESS AND APPARATUS FOR CREATING TUFTS FOR TUFTED ARTICLE

TECHNICAL FIELD

The present invention relates to a method and a device for processing bristle filaments, such as those used for making a variety of tufted articles, including, e.g., toothbrush, interdental brush, hairbrush, and the like.

BACKGROUND

The demands of the current market and increasingly sophisticated consumers encourage brush manufacturers to create brushes possessing improved functionality as well as aesthetic attractiveness. In the field of oral care, e.g., this involves a variety of benefits, including not only the expected basic plaque-and-tartar removal, but also an interdental-space treatment, tongue cleaning, gum treatment, and preventive care. This, in turn, requires more complex and sophisticated brush designs, including cleaning elements, such as bristle filaments. New shapes, geometries, and material compositions of the bristle filaments are among key elements that can greatly influence the efficacy of a brush.

In a conventional brush-making process, such as, e.g., a toothbrush-making process, bristle filaments can be supplied in large, generally round, filaments bundles that include hundreds of individual filaments tightly packed together. During a brush-manufacturing process, these filaments are separated into individual pucks, mechanically or chemically treated, cut, and eventually split into individual tufts—to be implanted into a body of the brush being made. The mechanical or chemical treatment may include end-rounding, thinning, tapering, polishing, and otherwise modifying the filaments ends, as is known in the art. The filaments, e.g., may be grinded to have their ends rounded, which ends otherwise would have sharp edges after the filaments are cut. These rounded ends will become free ends of the bristles in the finished brush. In a toothbrush, the filaments' rounded ends will contact a user's teeth and gums.

In some contemporary (so-called anchorless) brush-making processes, which do not require the insertion of metal anchors to retain the bristle filaments in the brush's plastic body, tufts of filaments, after being cut, end-rounded, and/or otherwise treated, are inserted into mold plates, having patterns of holes, or channels, corresponding to the desired geometry of the filament tufts in the brush being made. The tufts of filaments are inserted in a mold bar's holes so that the filaments' treated ends will form free ends of the finished brush's bristles, while the tufts' ends opposite to the treated ends will be over-molded with a molten plastic material and thereby embedded in the plastic body of the finished brush. Examples of such and similar processes can be found in the following patent documents: EP 1 878 355, EP0472863 B1, WO 2010105745, WO 2011128020, the disclosures of which are incorporated herein by reference.

In order to create sophisticated, increasingly complex brush designs, there is a need for the brush manufacturers to be able to form, at reasonable costs, multiple tufts patterns having elaborate configuration. The present disclosure is intended to satisfy this need.

SUMMARY OF THE INVENTION

A process for creating multiple tufts for a tufted article comprises: providing an initial filament bundle comprising a first plurality of individual filaments; directing the initial filament bundle into a first channel; causing the initial filament bundle to move through the first channel; splitting the initial filament bundle into a plurality of tufts according to a predetermined pattern, each tuft comprising a second plurality of individual filaments; and directing the plurality of tufts into a plurality of second channels such that each of the plurality of tufts moves through its own second channel defining a shape of the tuft moving therethrough.

An apparatus for creating the plurality of tufts comprises a first plate and a second plate adjacent to the first plate. The first channel can be disposed in a first plate, and the plurality of second channels can be disposed on a second plate. The channels may include chamfers at their respective ends in the plates. The first and second plates can be structured and configured to move relative to one another in operation; and a distance between the plates can be changeable according to a predetermined algorithm, based on the process's steps. The initial filament bundle can be directed into the first channel by a pin having a working surface that is structured and configured to push the initial filament bundle by contacting the bundle's free end. The pin's working surface can have a peripherally protruding flange structured to at least partially conform to a free end of the initial filament bundle comprising individual filaments having rounded ends. The pin's working surface can have a concavely shaped curvature configured to contact a corresponding convexly shaped curvature of the individual filaments' rounded ends.

The apparatus further comprises a splitting element structured and configured to separate the initial filament bundle into the plurality of individual tufts according to a predetermined pattern. The splitting element can be integrally formed with at least one of the plates. Alternatively, the splitting element can be fixed, permanently or detachably, on one of the plates—or be disposed between the plates. The splitting element has at least one splitting edge formed by at least two sides, or surfaces, tapering towards one another at an angle of from about 0.5 to about 150 degrees. The splitting edge can be rounded to have a radius comprising from about 3% to about 45% of an average diameter of the individual filament. The angle between the tapering surfaces may change throughout the tapering lengths thereof, either discretely or gradually. Longitudinal portions of the sides that taper towards each other are defined herein as "tapering" lengths. One or both of the tapering sides can be curved, either entirely or partially, i.e., at least one of the sides may comprise a curved portion or portions. The curvature may include a concave surface, a convex surface, or a combination thereof.

The splitting edge is structured and configured to penetrate the initial filament bundle from one of the bundle's ends, thereby splitting the bundle along its filaments. This way the single bundle can be split into two or more groups of filaments. During movement of the bundle relative to the splitting element, the tapering sides move the groups of filaments apart, directing them into the second channels, in which the individual tufts are formed. The individual tuft's cross-sectional shape and the number of individual filaments in each of the individual tufts being formed is defined, among other things, by the shape and size of the second channel.

The tufts created by the process may comprise a large number of complicated patterns, e.g., a pattern comprising at least one central tuft and several peripheral tufts surrounding the central tuft and a pattern comprising at least one central tuft and at least one tuft at least partially surrounding the at least one central tuft. The tufts may be identical—or may differ from one another in an equivalent diameter, a number of individual filaments, a cross-sectional shape, and other parameters. Although it is a common practice to use filaments having essentially round or circular cross-section, other filaments, having a cross-section which is not round, can be used in the disclosed invention. The term "equivalent diameter," used herein to define an area of a non-circular cross-section, constitutes the diameter of a hypothetical circular cross-section (e.g., of a filament or a channel) having the same area as that of the actual non-circular cross-section.

BRIEF DESCRIPTION OF THE DRAWINGS

The embodiments set forth in the drawings are illustrative and exemplary in nature—and are not intended to limit the subject matter defined by the claims. The detailed description of the illustrative embodiments can be understood when read in conjunction with the drawings, where like structures are indicated with like reference numerals.

FIGS. 1D and 1D2 schematically show a fragment D of FIG. 1C, exemplifying two different embodiments thereof.

FIG. 3A schematically shows a perspective view of a partial cross section of an embodiment of a plate having two elliptical channels and including a splitting device comprising a splitting edge that is not normal relative to a longitudinal direction of the channels.

FIG. 3B schematically shows a front view of the plate shown in FIG. 3A.

FIG. 3C schematically shows a back view of the plate shown in FIG. 3A.

DETAILED DESCRIPTION

Figure 1:
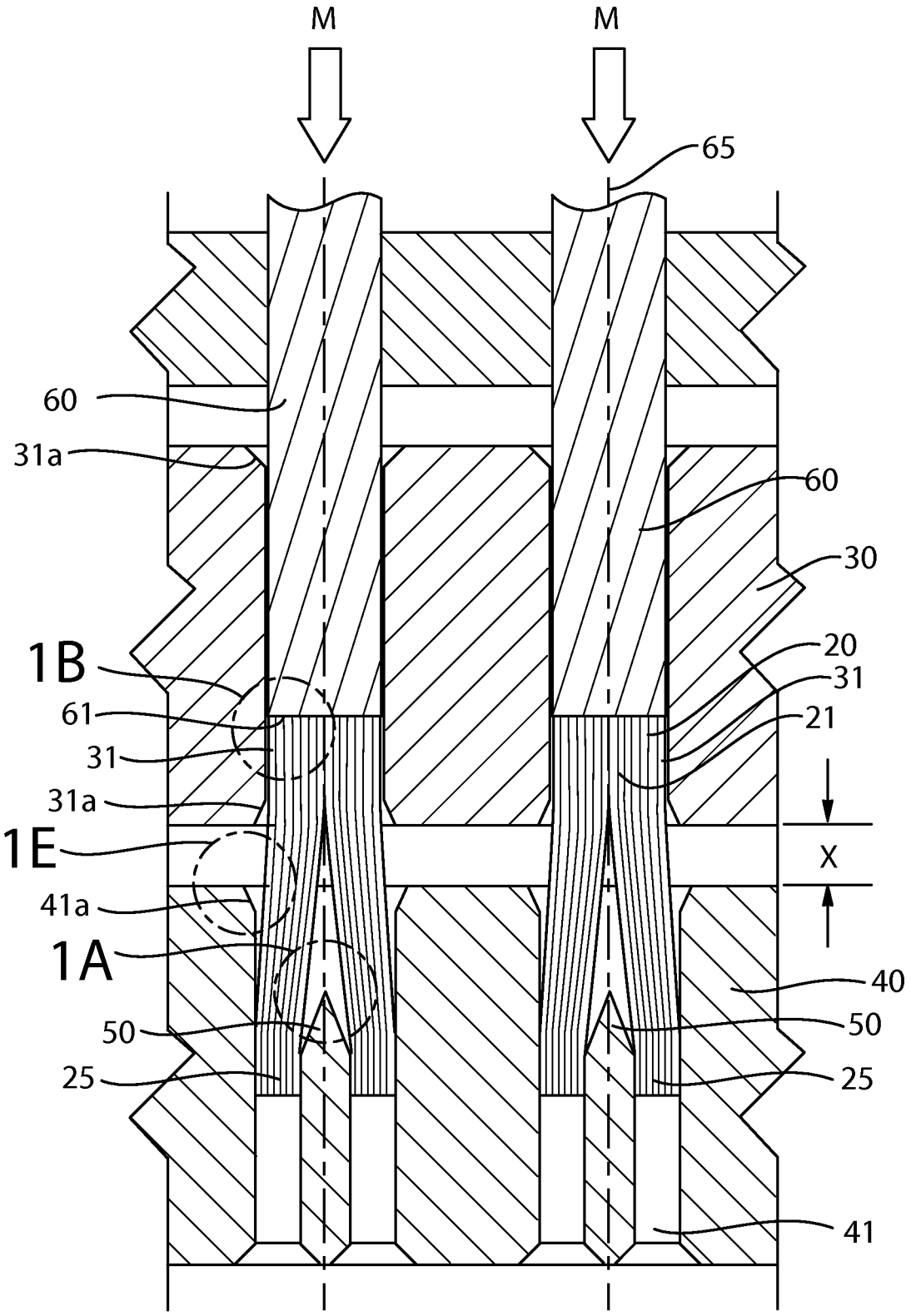
FIG. 1 schematically shows a process and an apparatus disclosed herein.

As is shown in FIG. 1, an embodiment of basic equipment for creating multiple filament tufts according to the present disclosure comprises a first plate 30, a second plate 40, a splitting element 50, and a pin 60. The first plate 30 has at least one first channel 31 disposed therein. There can be any number of first channels 31 in the plate 30, depending on the application. FIG. 1, e.g., shows the first plate 30 having two first channels 31. The first channel (or channels) 31 can be substantially round in cross-section, or have any other desired profile/cross-section, as will be explained herein below.

The first channel 31 is structured and configured to receive the initial filament bundle 20 comprising a first plurality of individual filaments 21 and to allow the initial filament bundle 20 to move inside the first channel 31. To this end, the surface of the first channel 31 can be treated to have low friction relative to the surface of the filaments in the bundle 20. Alternatively or additionally, the surface of the first channel 31 can be treated to decrease the friction between the walls of the channel and the filaments in the bundle 20. This can be accomplished by utilizing any known machining process, such as, e.g., an Electrical Discharge Machining (EDM) process. Alternatively or additionally, the surface of the channel 31 can be coated with friction-reducing materials, such as, e.g., Teflon. It is generally desired that the friction between the surface of the first channel 31 and the filaments in the bundle 20 contacting the surface of the first channel 31 be lower than the friction between the individual filaments 21 in the bundle 20.

After the initial filament bundle 20 is placed into the channel 31, a pin 60 can be used to move the initial filament bundle 20 forward, towards the second plate 40. The pin 60 can have any desired shape and a working surface 61 contacting a free end of the initial filament bundle 20. The pin's working surface 61, e.g., may be substantially flat and substantially perpendicular to a longitudinal axis 65 of the pin 60 (and thus substantially perpendicular to the longitudinal direction of the bundle 20 and the filaments 21). Alternatively, the working surface 61 may be inclined (not shown) so that there is an acute angle between the working surface 61 of the pin 60 and the pin's axis 65. In another embodiment (not shown), the pin's working surface 61 may include concave or convex portion or portions. Such configurations may be beneficial when it is desired to profile the free ends of the individual filaments 21. Other embodiments comprising various combinations of shapes of the pin's working surface 61, such as, e.g., a shape comprising at least one planar portion, at least one concave portion, and at least one convex portion (not shown), are contemplated by, and included in the scope of, the present invention.

Figure 1A:
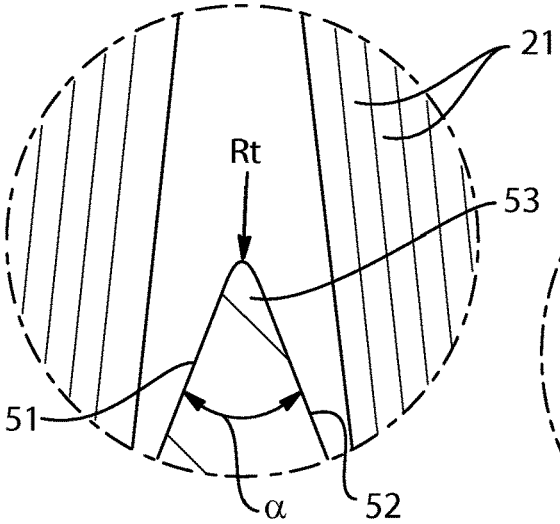
FIG. 1A schematically shows a fragment A of FIG. 1.
Figure 1B:
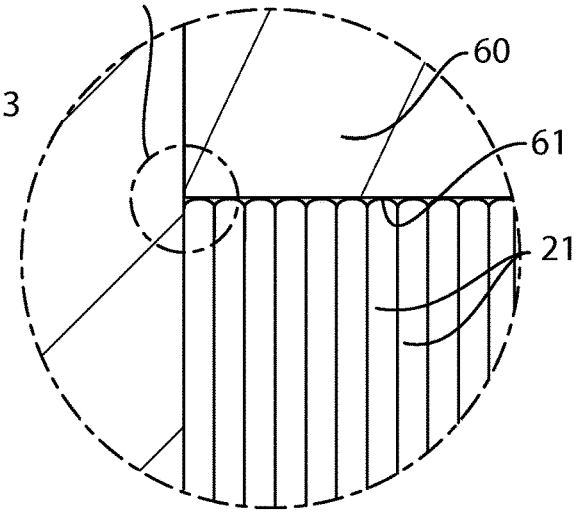
FIG. 1B schematically shows a fragment B of FIG. 1.
Figure 1C:
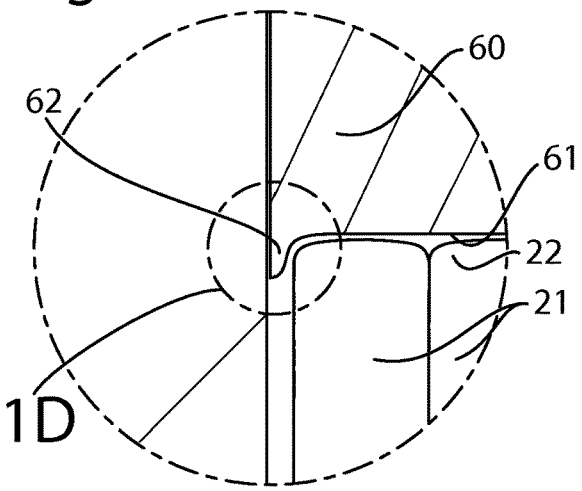
FIG. 1C schematically shows a fragment C of FIG. 1B.
Figure 1D:
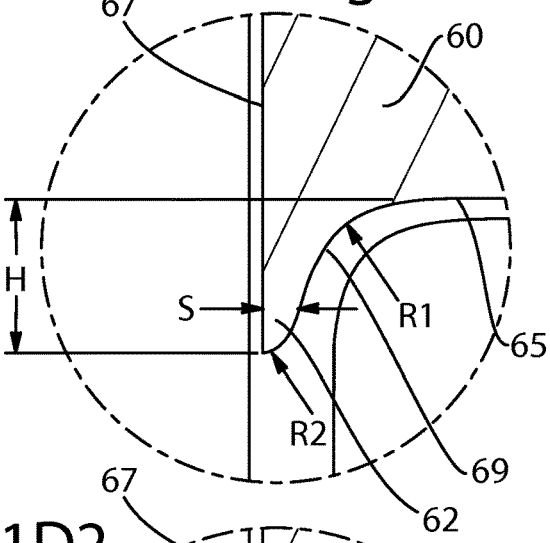

FIGS. 1B-1D show an embodiment of the pin's working surface 61 having a peripherally protruding flange 62. During operation, the flange 62 encompasses the initial filament bundle's free end in contact with the pin's working surface 61. As best seen in fragmentary cross-sections of FIGS. 1C and 1D, the pin's working surface 61, having the flange 62, is designed to accommodate the curvature of the filaments 21 whose free ends 22 have been rounded. To accomplish that, the working surface 61 can include a flange 62. An exemplary flange 62 shown in FIG. 1D comprises a curved surface including a concave portion and a convex portion thereof. The concave portion, having a radius R1, is configured to contact a corresponding convexly shaped curvature of the individual filaments' rounded ends 22. The dimensions and curvature(s) of the flange 62 can be defined primarily by the size/diameter and/or a shape of the filament bundle 20 and the individual filaments 21, particularly the relevant dimensions and shapes of their rounded ends 22. Those may differ from application to application, depending on the type of filaments being processed.

Generally, the flange 62 can have a height H from about 0.03 mm to about 0.4 mm. An average thickness S of the flange 62, as calculated based on its maximal thickness at a point where an inclined portion 69 of the flange 62 meets an adjacent portion 65 of the working surface 61 (shown as "horizontal" in FIGS. 1D and 1D2), and its minimal thickness at a point where the flange 62 terminates at the opposite end thereof, can be from about 0.03 mm to about 0.2 mm. In the exemplary embodiment shown in FIG. 1D, an "upper" radius R1 of the concave portion of the flange 62, adjacent to the "horizontal" surface 65 of the working surface 61, can be from about 0.02 mm to about 0.2 mm; and a "lower" radius R2 of the convex portion of the flange 62, adjacent to the "vertical" wall of the pin 61, can be from about 0.01 mm to about 0.15 mm. In other embodiments, the flange 62 can comprise a conventional, "triangle" configuration, appearing, e.g., as a substantially straight line inclined in a cross-section relative to both the "horizontal surface 65 and the "vertical" wall 67, as is shown in FIG. 1D2. Any and all combinations of the embodiments described herein are in the scope of the invention.

Figure 2A:
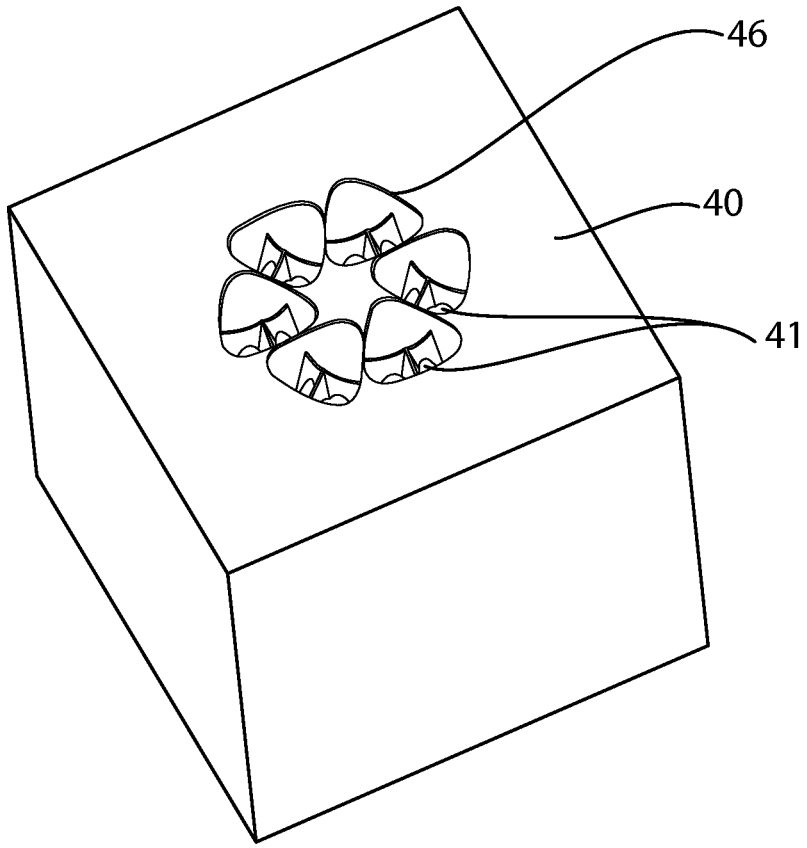
FIG. 2A schematically shows a perspective view of an embodiment of a plate including a splitting device comprising three pairs of tapering surfaces forming three splitting edges.
Figure 2B:
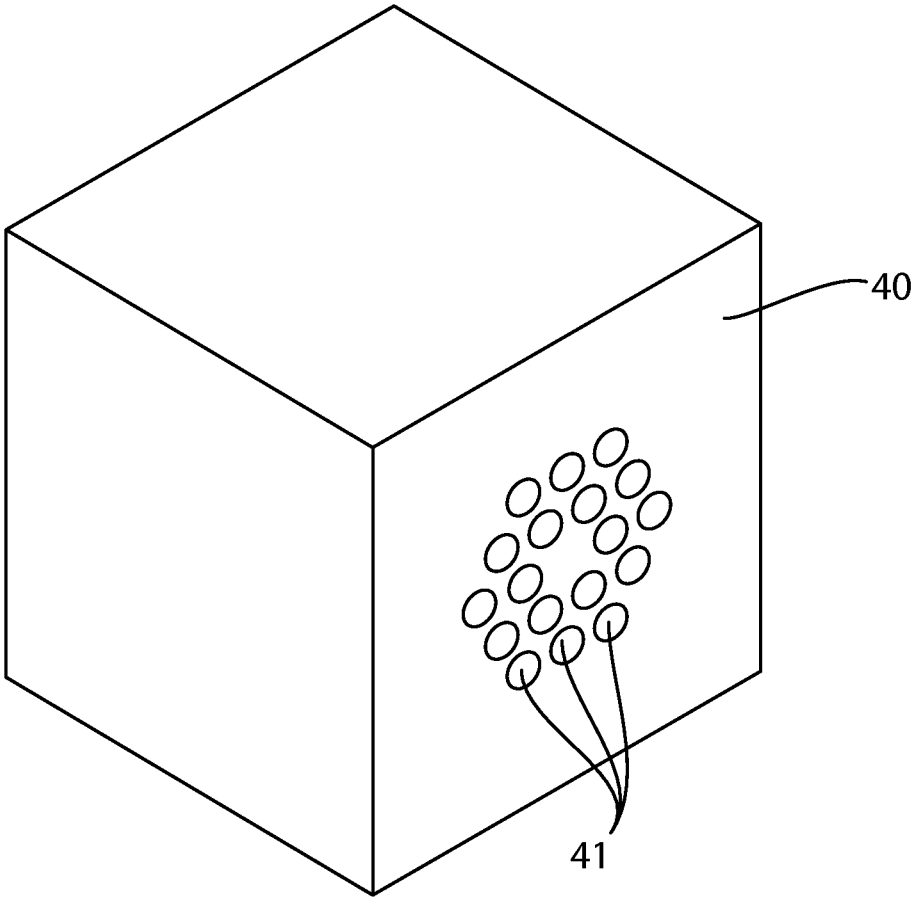
FIG. 2B schematically shows a perspective view of an embodiment of a plate including eighteen channels structured and configured to form eighteen individual tufts of filaments therein.

The second plate 40 has at least two second channels 41. The second channel's cross-sectional area is generally smaller than that of the first channel 31. The number of the second channels 41 is dictated by a design of the product being made. More specifically, the number of the second channels 41 is defined by the number of the individual tufts 25 that need to be created. In FIG. 1, e.g., the second plate 40 is shown to have four second channels 41 (two second channels 41 per each first channel 31), while and in FIGS. 2A-2C, e.g., the second plate 40 is shown to have six clusters 46, each including three second channels 41; altogether, there are eighteen second channels 41, as is best shown in FIG. 2B.

Figure 2C:
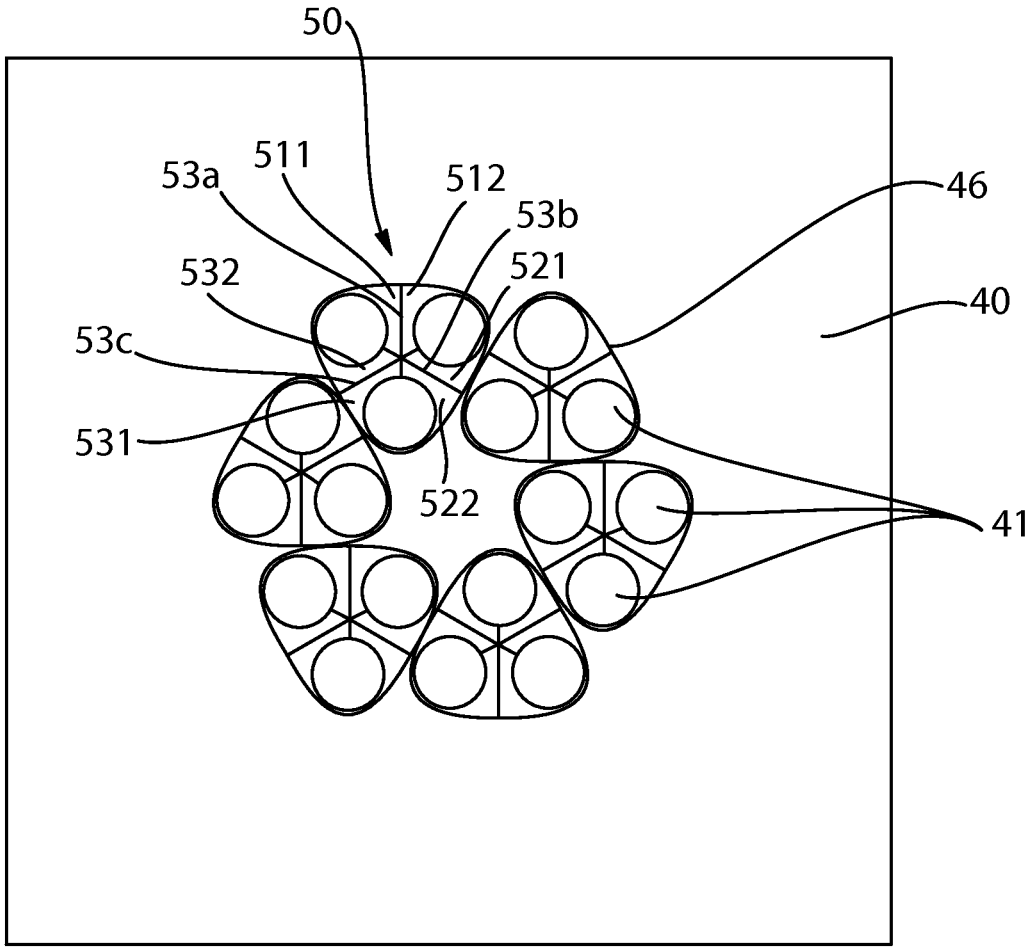
FIG. 2C schematically shows a front view of the plate shown in FIG. 2A.

The second channel 41 may have any desired profile or cross-section, reflecting the desired profile/cross-section of the individual tuft 25 formed therein. In the embodiment of FIGS. 2A-2C, e.g., the second channels 41 are substantially round, while in the embodiment of FIGS. 3A and 3B, e.g., the second channels 41 are elliptical.

During the process of filament transfer from the first plate 30 to the second plate 40, the plates 30, 40 are disposed adjacent to one another. The plates 30, 40 can touch one another so that there is no space therebetween. Alternatively, the plates 30, 40 can have a space X therebetween (FIG. 1) from about 0.1 mm to about 2.0 mm. As one skilled in the art will readily understand, during the brush-making process, the plates 30, 40 can be movable relative to one another, whereby the distance X between the plates 30, 40 can be changed according to a predetermined algorithm, based on the process parameters.

Figure 1E:
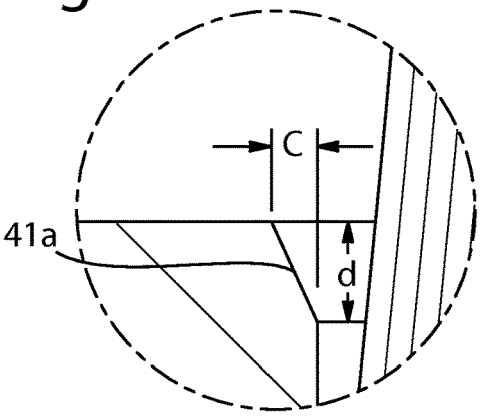
FIG. 1E schematically shows a fragment E of FIG. 1.
Figure 1E:
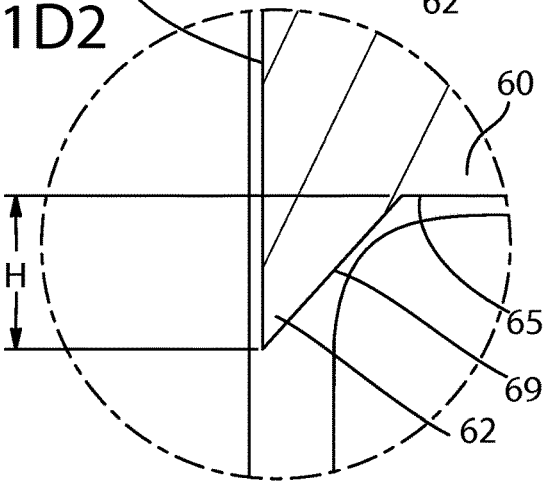

The channels 31, 41 can be beneficially provided with chamfers 31*a*, 41*a*, respectively (FIGS. 1 and 1E). The chamfers can facilitate the insertion of the initial filament bundle 20 into the first channel 31 and transfer of the filaments from one channel (e.g., 31) to another (e.g., 41). The size and shape of the chamfers 31*a*, 41*a* can be defined by the type and size of the filaments 25 being processed and those of the bundle 20 and the tufts 25. For many toothbrush-making applications, the chamfers 31*a*, 41*a* can beneficially comprise a beveled surface inclined relative to a longitudinal axis of the channel (31 or 41) it is associated with, and having dimensions defined, e.g., by two mutually perpendicular projections "c" and "d," (FIG. 1E). The angle of the beveled surface's inclination and the dimensions c and d can be based, among other things, on the equivalent diameter of the individual filaments 21 in the bundle 20.

A splitting element 50 is a device that is structured and configured to separate the initial filament bundle 20 into several individual tufts 25 of predetermined size and shape. In an embodiment shown in FIGS. 1A and 3A, the splitting element 50 has at least two sides 51, 52 tapering towards one another. An angle $\alpha$ formed between the sides 51 and 52 (FIG. 1) can be from about 0.5 degrees to 150 degrees, e.g., from 0.5 degree to 150 degree, from 1 degree to 100 degrees, from 2 degree to 90 degree, from 3 degree to 60 degree, from 5 degree to 50 degree. This angle can be more precisely defined based on the properties of the material, friction, overall design of the plates 30 and 40, and other relevant factors. It may be beneficial to provide a radius Rt at an edge 53 where the sides 51, 52 meet (FIG. 1A). The radius Rt can be primarily defined by the diameter, or equivalent diameter, of the individual filaments 21 comprising the bundle 20. In some embodiments, the radius Rt can be, e.g., from about 3% to about 75% of the filament's average diameter or equivalent diameter. This radius can be considered as a local radius of curvature.

Figure 4:
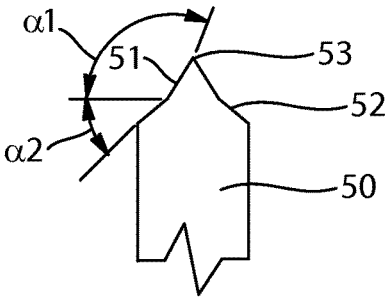
FIG. 4 schematically shows an embodiment of the splitting device comprising substantially planar tapering surfaces that form multiple angles therebetween.
Figure 5:
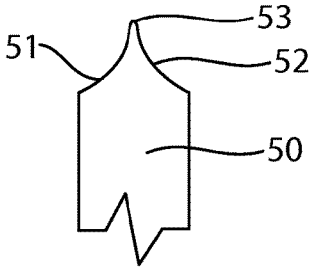
FIG. 5 schematically shows an embodiment of the splitting device comprising concave tapering surfaces.
Figure 6:
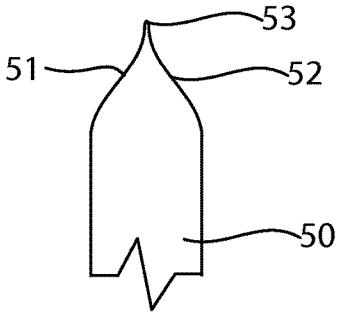
FIG. 6 schematically shows an embodiment of the splitting device comprising curved tapering surfaces including concave and convex portions.

The angle $\alpha$ can be constant throughout the length of the tapering sides 51, 52, as is shown, e.g., in FIGS. 1 and 1A. Alternatively, the angle $\alpha$ can change throughout the length of the tapering sides 51, 52, as is shown, e.g., in FIGS. 4-6. This change in the angle $\alpha$ can be discreet (angles $\alpha$1 and $\alpha$2 in FIG. 4) or gradual (FIGS. 5 and 6). In the latter instance, at least one of the sides 51, 52 can comprises a curved surface. While FIG. 5 shows an exemplary embodiment in which both of the sides 51, 52 comprise concave surfaces, it should be understood that only one of the sides 51, 52 can be curved. Further, an embodiment in which at least one of the sides 51, 52 is concavely shaped, or includes a concave portion, is also contemplated, FIG. 6. It should be also understood that the same or similar principles of design can be applied to the splitting device 50 comprising more than two surfaces, e.g., the embodiment shown in FIGS. 2A-2C.

Figure 7:
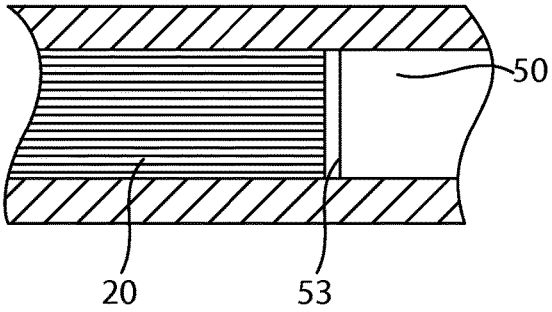
FIG. 7 schematically shows an embodiment of the splitting device comprising a splitting edge that is substantially perpendicular to the longitudinal direction of the filaments disposed in the channel.
Figure 8:
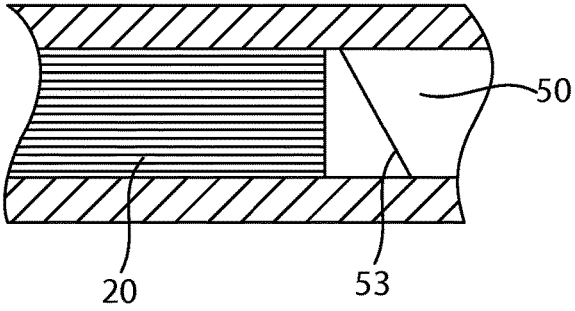
FIG. 8 schematically shows an embodiment of the splitting device comprising a splitting edge that is not perpendicular to the longitudinal direction of the filaments disposed in the channel.
Figure 9:
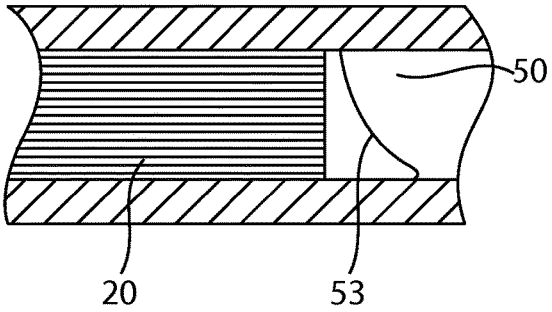
FIG. 9 schematically shows an embodiment of the splitting device comprising a splitting edge having a convex shape.

In one embodiment of the splitting device 50, the edge 53 can be generally perpendicular to the longitudinal direction of the filaments (or the longitudinal axis 65 of the pin 60), FIG. 7. In this embodiment, the first contact between the edge 53 and the filaments 21 in the initial filament bundle 20 occurs substantially at the same time. At the same time, it is possible, and may even be desirable, to provide for gradual, or progressive splitting of the initial filament bundle 20 with respect to its thickness (or equivalent diameter). In the embodiment of FIG. 8, e.g., the edge 53 is inclined relative to the filament's longitudinal direction. In this embodiment, an acute angle exists between the edge 53 and the vertical "thickness" (or diameter) of the bundle 20. This will cause the edge 53 to gradually "enter" the initial filament bundle 20—and consequently the filaments 21 in the initial bundle 20 will contact the edge 53 progressively, depending on these filaments' vertical location. In yet another embodiment, the edge 53 can be curved, FIG. 9. The curved edge 53, too, will cause the filaments 21 in the initial bundle 20 to contact the edge 53 not at the same time, but gradually, or progressively, instead. The last two embodiments are believed to provide a smoother splitting of the filaments in the initial bundle 20. While FIG. 9 shows a convexly curved edge 53, the splitting element 53 can also have a concavely curved edge 53 (not shown). Other embodiments (not shown) in which the edge 53 can comprise any combination of the shapes and configurations described herein are included in the scope of this disclosure. For example, the splitting element 50 can have the edge 53 that is partially perpendicular, and partially inclined relative to the longitudinal direction of the filaments, and/or partially curved (either convexly, or concavely, or both).

As the filament bundle 20 passes through the splitting device 50 (in a direction of an arrows M, FIG. 1), the bundle 20 is being separated into smaller filament portions—and eventually into individual tufts 25 in the second channels 41. The number of filaments 21 in each of the tufts 25 reflects the geometries of the splitting element 50 and the second channels 41. And the final cross-section of the individual tufts 25 is primarily defined by the corresponding parameters of the second channels 41.

In an exemplary embodiment shown in FIG. 2C, each of the six splitting elements 50 includes three edges: 53*a*, 53*b*, and 53*c*, and three pairs of corresponding tapering surfaces: 511-512 (meeting at the edge 53*a*), 521-522 (meeting at the edge 53*b*), and 531-532 (meeting at the edge 53*c*). In this embodiment, a portion of the initial bundle 20 will be split into three individual tufts 25, and the entire individual bundle into eighteen tufts 25. It should be appreciated that the individual filaments 25 do not need to have equal number of filaments 21—nor do they need to have identical or similar cross-sectional shapes.

While in the several embodiment shown, the splitting element 50 is structured to separate the bundle 20 into the tufts 25 having similar cross-section and approximately equal number of individual filaments 21, the splitting element can be structured to split the bundle 20 into the tufts 25 having dissimilar cross-sections and differential number of individual filaments 21. One of the advantages of the present invention is the flexibility it affords to one in creating complex shapes and configurations of the tufts being formed. The present invention allows one to create tufts according to predetermined complex patterns, wherein the tufts can differ from one another in at least one parameter selected from the group consisting of an equivalent diameter, a number of individual filaments, a cross-sectional shape, and a size of a cross-sectional area.

Figure 10:
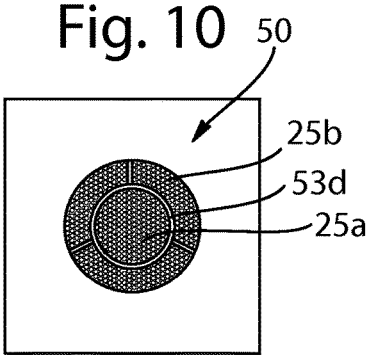
FIG. 10 schematically shows an embodiment of the splitting device comprising an annular splitting edge.

In yet another exemplary embodiment, shown in FIG. 10, the splitting element 50 comprises a structure having a generally annular edge 53*d*. This can split the bundle 20 into at least two tufts: a "central" tuft 25*a* and a "surrounding" tuft 25*b* encompassing, or at least partially encompassing in other embodiments (not shown), the central tuft 25*a*. While FIG. 10 shows the tufts 25*a* and 25*b* having generally round shapes and being concentric with one another, it should be understood that the tufts 25*a*, 25*b* may have any suitable shape (e.g., semi-annular, ellipsoidal, rectangular, polygonal, et cetera)—and do not need to be concentric. Nor the "surrounding" tuft 25*b* need be endless, i.e., comprise an essentially complete circle; the splitting element 50 can be configured to create, e.g., the surrounding tuft 25*b* having a curved, arcuate, C-shaped, or crescent-like cross-section (none shown). Furthermore, this disclosure is not limited to the like embodiments having only one "central" tuft and only one "surrounding" tuft. Using the design principles disclosed herein, one skilled in the art will be able to envision other similar arrangements, having two, three, or more "central" tufts and two, three, or more "surrounding" tufts; all of these arrangements are included in the scope of the present disclosure.

The splitting element 50 can be located in the first plate 30, the second plate 40, or be disposed intermediate the first and second plates 30, 40. The splitting element 50 can be affixed or removably attached to either of the plates 30, 40. Alternatively, the splitting element 50 can be formed integrally with one of the plates 30, 40. In the several exemplary embodiments shown the splitting element 50 is formed integrally with the second plate 40.

The process and the apparatus disclosed herein are believed to allow brush makers to create, with great precision, brushes having complex designs of the bristle filaments, while at the same time affording them greater flexibility in changing the geometries and patterns of the filament bristles for a variety of brushes.

While particular embodiments have been illustrated and described herein, various other changes and modifications may be made without departing from the spirit and scope of the invention. Moreover, although various aspects of the invention have been described herein, such aspects need not be utilized in combination. Likewise, various aspects of the invention and various embodiments of the elements described herein can be used in various combinations, all of which are contemplated in the present disclosure. It is therefore intended to cover in the appended claims all such combinations, changes, and modifications that are within the scope of the invention.

The terms "substantially," "about," "approximately," and the like, as may be used herein, represent the inherent degree of uncertainty that may be attributed to any quantitative comparison, value, measurement, or other representation. These terms also represent the degree by which a quantitative representation may vary from a stated reference without resulting in a change in the basic function of the subject matter at issue. Further, the dimensions and values disclosed herein are not to be understood as being strictly limited to the exact numerical values recited. Instead, unless otherwise specified, each such dimension is intended to mean both the recited value and a functionally equivalent range surrounding that value. For example, a value disclosed as "45%" is intended to mean "about 45%."

The disclosure of every document cited herein, including any cross-referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein—or that it alone, or in any combination with any other reference or references, teaches, suggests, or discloses any such invention. Further, to the extent that any meaning or definition of a term in this document conflicts with any meaning or definition of the same or similar term in a document incorporated by reference, the meaning or definition assigned to that term in this document shall govern.

What is claimed is:

1. A process for creating multiple tufts for a tufted article, the process comprising:

providing an initial filament bundle comprising a first plurality of individual filaments;

directing the initial filament bundle into a first channel;

pushing the initial filament bundle by a pin abutting a free end of the initial filament bundle inside the first channel, thereby causing the initial filament bundle to move through the first channel in a direction substantially parallel to a longitudinal direction of the initial filament bundle;

splitting the initial filament bundle into a plurality of tufts according to a predetermined pattern, each tuft comprising a second plurality of individual filaments;

wherein splitting the initial filament bundle into a plurality of tufts according to a predetermined pattern comprises driving an opposite end of the free end of the initial filament bundle through a splitting element that separates the initial filament bundle into the plurality of individual tufts according to a predetermined pattern; and directing the plurality of tufts into a plurality of second channels such that each of the plurality of tufts moves through its own second channel defining a shape of the tuft moving therethrough in a direction substantially parallel to a longitudinal axis of the channel.

2. The process of claim 1, wherein directing the initial filament bundle into a first channel comprises causing the initial filament bundle to move through the first channel disposed in a first plate towards a second plate having the plurality of second channels therein.

3. The process of claim 1, wherein splitting the initial filament bundle into a plurality of tufts according to a predetermined pattern comprises splitting the initial filament bundle into at least two tufts.

4. The process of claim 1, wherein splitting the initial filament bundle into a plurality of tufts according to a predetermined pattern comprises splitting the initial filament bundle into at least a first tuft and a second tuft, wherein said at least first and second tufts differ from one another in at least one parameter selected from the group consisting of an equivalent diameter, a number of individual filaments, and a cross-sectional shape.

5. The process of claim 1, wherein splitting the initial filament bundle into a plurality of tufts according to a predetermined pattern occurs gradually with respect to a thickness of the initial filament bundle.

* * * * *